US005164592A

United States Patent [19]

Kitamori et al.

[11] Patent Number: 5,164,592

[45] Date of Patent: Nov. 17, 1992

[54] METHOD AND APPARATUS FOR MASS SPECTROMETRIC ANALYSIS

[75] Inventors: Takehiko Kitamori, Ushiku; Masataka Koga; Tsuyoshi Nishitarumizu, both of Katsuta; Tetsuya Matsui; Kenji Yokose, both of Hitachi; Masaharu Sakagami, Katsuta, all of Japan

[73] Assignee: Hitachi, Ltd., Tokyo, Japan

[21] Appl. No.: 581,908

[22] Filed: Sep. 13, 1990

[30] Foreign Application Priority Data

Sep. 20, 1989 [JP] Japan ..... 1-242195

[51] Int. Cl.[5] ..... H01J 49/10

[52] U.S. Cl. ..... 250/288; 250/281; 250/282

[58] Field of Search ..... 250/288, 282, 281, 423 P, 250/423 R, 287; 356/318

[56] References Cited

U.S. PATENT DOCUMENTS

| | | | |
|---|---|---|---|
| 3,644,731 | 2/1972 | Eloy | 250/288 |
| 3,673,405 | 6/1972 | Moorman et al. | 250/288 |
| 3,727,047 | 4/1973 | Janes | 250/287 |
| 3,953,732 | 4/1976 | Oron et al. | 250/287 |
| 4,433,241 | 2/1984 | Boesl et al. | 250/423 P |
| 4,634,864 | 1/1987 | Lucatorto et al. | 250/288 |
| 4,733,073 | 3/1988 | Becker et al. | 250/287 |
| 4,818,862 | 4/1989 | Conzemius | 250/287 |
| 4,849,628 | 7/1989 | McLuckey et al. | 250/423 F |
| 4,970,390 | 11/1990 | Szymczak | 250/287 |

OTHER PUBLICATIONS

Conzemius et al, "A Review of the Applications to Solids of the Laser Ion Source in Mass Spectrometry", International Journal of Mass Spectrometry and Ion Physics, vol. 34, Nos. 3,4, Jul. 1980, Amsterdam, NL, pp. 197-271.

Bykovskii et al, "Quantitative Analysis of Solids in a Mass Spectrometer with a Laser Ion Source Without Independent Calibration," Sov. Phys. Tech. Phys., vol. 21, No. 6, (Jun. 1976).

*Primary Examiner*—Jack I. Berman
*Assistant Examiner*—Kiet T. Nguyen
*Attorney, Agent, or Firm*—Fay, Sharpe, Beall, Fagan, Minnich & McKee

[57] ABSTRACT

The power density of a pulsed laser beam for irradiating a sample is adjusted to break down the sample into the form of a plasma. After the momentary breakdown of the sample into the form of a plasma, ions are generated having a high charge. Then, after a certain time elapses, the ions having a high charge recombine with the electrons in the plasma to provide monovalent or low valent ions. These low valent ions are taken out of the plasma and introduced to a mass spectrometric apparatus.

27 Claims, 8 Drawing Sheets

METHOD AND APPARATUS FOR MASS SPECTROMETRIC ANALYSIS

BACKGROUND OF THE INVENTION

1. FIELD OF THE INVENTION

The invention relates to a method and apparatus for mass spectrometric analysis, and in particular to an apparatus for and a method of spectrometrically analyzing a sample mass that is ionized by a laser beam.

2. DESCRIPTION OF RELATED ART

In one type of conventional mass spectrometric analyzing apparatus, the sample is ionized by an atmospheric ionizing method. For example, the sample is ionized by a glow discharge method. This type of apparatus, however, is restricted in use to ionizing gaseous samples, and is consequently disadvantageous for use in analyzing a wide variety of samples.

An example of a mass spectroscope that uses a laser for ionizing the sample portion is disclosed in the Proceedings of the 23rd Applied Spectrometry in Tokyo, 1988, at 135, 137. In this type of apparatus, a sample is irradiated with a laser beam for ionization, and only the surface of the solid is irradiated. This causes simple ionization of the surface molecules, or generates ions by sputtering. Laser breakdown, which will be described later, is not produced because the power density of the laser beam is low. Therefore, the apparatus is restricted to analyzing the surface of a solid.

In Japanese Patent Publication No. 46340/1983, a method of separating isotopes by irradiating a target with a laser beam for ionization and spectrum analysis of the mass of the ions is disclosed. The object of this method is to separate the isotopes. A laser beam of a very high intensity is used to ionize the target. A plasma is produced, and the ions generated are in a charged state that is greater than ten times as high as the charged state of a single electron. As a result, the same element of the sample in the plasma that is produced has not fewer than ten different charged states. Accordingly, the Z/m (Z being the ion charge, and m the mass) is different for each of the charged states of the same element. If the isotopes are separated by a mass spectrometer, then the same elements are collected by separate depositors (isotope collectors). The target material composition is analyzed with high sensitivity if the same elements are collected by the same depositor of the mass spectrometer. However, in this example, the same elements are collected by separate depositors depending upon the charged states, and different elements having the same Z/m value are collected by the same depositor. As a result, this type of ionizing apparatus is not appropriate for the separation and quantitative determination of only the mass m which is necessary for the analysis of a material composition.

In Japanese Patent Laid-Open No. 78384/1975, a mass spectrometric analysis of particles in an explosive plasma that is produced by laser fusion is disclosed. In this apparatus, the charged particles have the same Z/m value and different initial speeds are introduced to the same detector by utilizing a time-dependence type charged particle separating magnetic field in order to measure the mass and the charge of the particles with high sensitivity. The plasma described in this example is plasma having a high temperature and a high density produced by laser irradiation for nuclear fusion. Since the intensity of the laser beam is high, the ion charges are also high. Accordingly, the same elements have different charged states and this type of ionizing method is unsuitable for the analysis of ordinary material compositions.

In West German Patent Laid-Open No. 252010, a method of spectrometrically analyzing the mass of the ions of a plasma that is produced by a laser deposition apparatus is disclosed. The laser deposition apparatus irradiates the material for the substance to be deposited on a substrate with a laser beam to evaporate the substance in the form of atoms or molecules. Part of the evaporated atoms or molecules are ionized by the irradiation of the laser beam. These ions, atoms or particles ordinarily collide with the ions, atoms or particles therearound and form minute clusters. The clusters having charges or ions are taken out by an electrode and introduced onto the substrate. The clusters or ions adhere to the substrate, thereby forming a thin film. Generally, the evaporated gas contains neutral atoms, particles, and the clusters and ions thereof. In order to observe the mass and the charge of the evaporated substance, therefore, the ion components are introduced to the mass spectrometer so as to spectrometrically analyze them. In the analysis, the evaporated atoms, molecules and ions generated during evaporation and the ion components in the clusters are utilized. This mass spectrometric analysis is different from a mass spectrometric analysis in which a material is positively and efficiently evaporated in the form of atoms and ionized for the purpose of elemental analysis (to determine atomic composition) of the material.

The conventional apparatus, described above, for ionizing samples using a laser beam for various purposes is unsuitable for mass spectrometric analysis intended for the analysis of a material composition. That is, even if a conventional laser apparatus is used in the field of mass spectrometric analysis, the ions generated by the laser beam irradiation are not in a predominantly low charged state, and therefore, are not suitable for mass spectrometric analysis.

In addition, when particle components in a liquid or a solid are analyzed, selective and efficient ionization of the particle components is not taken into adequate consideration in the practice of analysis with conventional apparatus. Therefore, it is difficult to analyze a material of various forms such as solids, liquids, and gases for elemental constituents with high sensitivity.

An analysis apparatus that uses a laser beam for laser breakdown of the sample is known. In such an analyzing method using laser breakdown, fine particles in the liquid are counted by using a sound wave generator, as described in, for example, Japanese Journal of Applied Physics, 1988, 27, at L983. Alternatively, it is known to analyze a liquid for elemental constituents by spectrum analysis of a plasma emission produced by laser breakdown, as described in Applied Spectroscopy, 1984, 38, at 721. That is, mass spectrometric analysis using ions generated by the laser breakdown of a sample is not carried out in these type of apparatus.

SUMMARY OF THE INVENTION

It is an object of the present invention to provide a method and apparatus for the mass spectrometric analysis of samples in gaseous, liquid and solid states.

It is an object of the present invention to spectrometrically analyze a mass by producing predominantly monovalent or low valent ions with high efficiency that are suitable for mass spectrometric analysis.

It is a further object of the present invention to spectrometrically analyze a mass with high sensitivity by selectively ionizing a sample in a solid, liquid or gaseous state or by ionizing a solid substance (particulate substance) sample contained in a liquid or gas.

It is an object of the present invention to spectrometrically analyze the mass of ions generated by momentary ionization with an apparatus that is efficient in size and simple in operation.

In the present invention, a sample object is ionized by breaking down (a kind of insulation breakdown) a part or the entire part of the sample object by irradiating the sample with a laser beam, preferably a pulse laser beam generated by a pulse laser. The power density of the laser beam is adjusted so that the ions generated by the breakdown of the sample have a low charge. The adjustment is made so that the power density of the laser beam is not only higher than the threshold value for the breakdown of the sample, but also near the threshold value.

After the momentary breakdown of the object of analysis or sample into the form of a plasma by irradiating the sample with a pulse laser beam, and after a certain time has elapsed since the plasma is formed wherein the ions generated with a high charge are recombined with the ionized electrons to produce monovalent or low valent ions, the ions are taken out of the plasma and introduced to an apparatus for the mass spectrometric analysis thereof.

Selective breaking down of a solid, liquid or gaseous sample, and of a particulate substance contained in a liquid or gas can be accomplished by adjusting the power density of the laser beam to the threshold value of the sample. There is a difference in threshold value of the power density of the laser beam that is necessary for breaking down liquids, gases, solids and particulate substances contained in a liquid or gas. Therefore, samples in various physical states can be analyzed by mass spectrometric analysis with the apparatus of the present invention, and according to the method of the present invention.

The pulse laser beam is used to break down an object of analysis or sample into the form of a plasma by a thermal, optical and electric effect of the laser beam. This phenomenon is called laser breakdown, and is achieved when the power density of the laser beam is not less than $10^{10}$ W/cm$^2$. The power density is adjusted by condensing the laser beam with a convex lens, or the like. In the plasma produced by the laser breakdown, ions and electrons are contained in a mixed state. The ions that are generated recombine with the electrons in the plasma to form neutral atoms. Before the recombination, the ions are taken out for mass spectrometric analysis.

With reference to FIGS. 13(*a*) and 13(*b*), an example of a plasma emission spectrum obtained by spectrometrically measuring a temporal variation of a plasma emission generated when a pulse laser is used to irradiate a solution sample for breaking it down into the form of a plasma is shown. Although the plasma emission spectrum shown in each of the figures is the same, FIG. 13(*b*) shows the plasma emission spectrum diagram with the ordinate magnified ten times. The solution sample is an aqueous Na solution. According to the results shown in the figures, the plasma emission continues for about 5 to 6 μseconds. It is sufficiently possible to take out the ions for the mass spectrometric analysis during this period. White light from the plasma is observed immediately after the breakdown and thereafter the Na atom emission lines (D-lines having wavelengths of 589.0 nm and 589.6 nm) are distinctly observed. Immediately after the breakdown of the solution, Na is converted into monovalent or low valent ions and can assume various excited states, so that light of various wavelengths is emitted in accordance with the exciting state. As a result, white light is observed. As time elapses after the breakdown, the polyvalent ions combine with the electrons, thereby producing monovalent Na ions. When electrons recombine with the monovalent Na ions to produce neutral Na atoms, the combined electrons change the state into the ground state, thereby emitting the Na atoms emission lines (D-lines).

In FIG. 13(*b*), the magnified ordinate of the spectrum diagram shows that the atom emission lines are distinctly observed after elapse of about 300 ns, which indicates that a multiplicity of monovalent Na ions have been generated during the process of extinguishing the plasma. It is considered from the strong Na atom emission lines that are observed after about 300 ns have passed, that a multiplicity of monovalent Na ions have been generated in this period, and it is further considered that a multiplicity of monovalent or divalent ions have been generated in the breakdown plasma.

If an electromagnetic force, for example, is applied to the plasma when the atom emission line begins to be observed after the generation of the breakdown plasma, it is possible to take out the monovalent ions with high efficiency.

The power density of the laser beam that is necessary for breaking down a substance or sample is different for solids, liquids and gases. When the power density of the beam is in the order of $10^{10}$ W/cm$^2$, the breakdown of a solid is produced. When the power density is in the order of $10^{11}$ W/cm$^2$, the breakdown of a liquid is produced. Further, when the power density of the laser beam is in the order of $10^{12}$ W/cm$^2$, the breakdown of a gas is produced. These power level densities are described in U.S. patent application Ser. No. 07/334,358, entitled "Analytical Method for Particulate Substances, Relevant Analytical Equipment and its Application System".

In view of the differing power density levels for solids, liquids and gases, it is possible to selectively break down and ionize a sample or object of analysis by appropriately setting the power density of the beam in accordance with the form or state of the sample. Since the power density for breaking down a solid is less than that for a liquid, it is possible to break down a solid particulate substance in a liquid medium without breaking down the liquid medium. Similarly, it is possible to selectively ionize a particulate substance in a gaseous medium without breaking down the gaseous medium. Further, with the apparatus of the present invention, it is possible to ionize a substance by laser breakdown whether the substance is a conductor, semiconductor or insulator. Therefore, it is possible to ionize and then analyze a wide range of substances, such as solids, including metals and oxides in a gas or liquid medium, as well as gases and liquids themselves.

Ionization is caused by irradiating the sample with a laser beam. In order to obtain the power density of the laser beam that is necessary for the laser breakdown, the laser is preferably subjected to pulse oscillation. In order to analyze the ions that are generated, a time-of-flight mass spectrometric analyzing method that is capable of being actuated synchronously with the pulse oscillation of the laser beam is preferably used. In this preferred system, the pulse laser beam irradiates the object of analysis or sample for breaking it down, and the ions in the plasma produced are taken out by, for example, an electrode with a voltage applied thereto and introduced into the time-of-flight mass spectrometer. If it is assumed that the voltage applied to the electrode is V, the mass m and the velocity v of the ions having a charge (valence) of q are obtained according to the following equation:

$$\frac{1}{2}mv^2 = qV \quad (1)$$

Therefore, in the time-of-flight mass spectrometer for a distance L of flight, the time T of flight of the ions is represented by the following formula:

$$T = \frac{L}{v} = \sqrt{\frac{m}{2qV}} \cdot L \quad (2)$$

Rearranging formula (2), the following formula is obtained:

$$\frac{m}{q} = \frac{2T^2V}{L^2} \quad (3)$$

It is therefore possible to obtain the m/q of the ions from the formula (2) by measuring the period T between the time of the production of the breakdown and the time of the detection of the ions. In particular, when the ions are monovalent (q=e, wherein e represents a charge of an electron), T and m have a relationship of 1 : 1, so that by measuring the time T of flight, it is possible to obtain the mass m of the ions, thereby identifying the element. The measurement starting time for the time T of flight can be the oscillating time of the pulse laser, the time at which the pulse laser beam is observed, the time at which the plasma emission is observed or a predetermined time after these times are set. Further, as for the timing of applying a voltage to the electrode for taking out the ions from the plasma, the time at which the atom emission lines or the monovalent or low valent ion emission lines are observed in the plasma emission, or the like, may be utilized.

BRIEF SUMMARY OF THE DRAWING

Further objects, features and advantages of the present invention will become clear from the following Detailed Description of the Preferred Embodiments, as shown in the accompanying drawing, wherein.

DETAILED DESCRIPTION OF THE PREFERRED EMBODIMENTS

Figure 1:
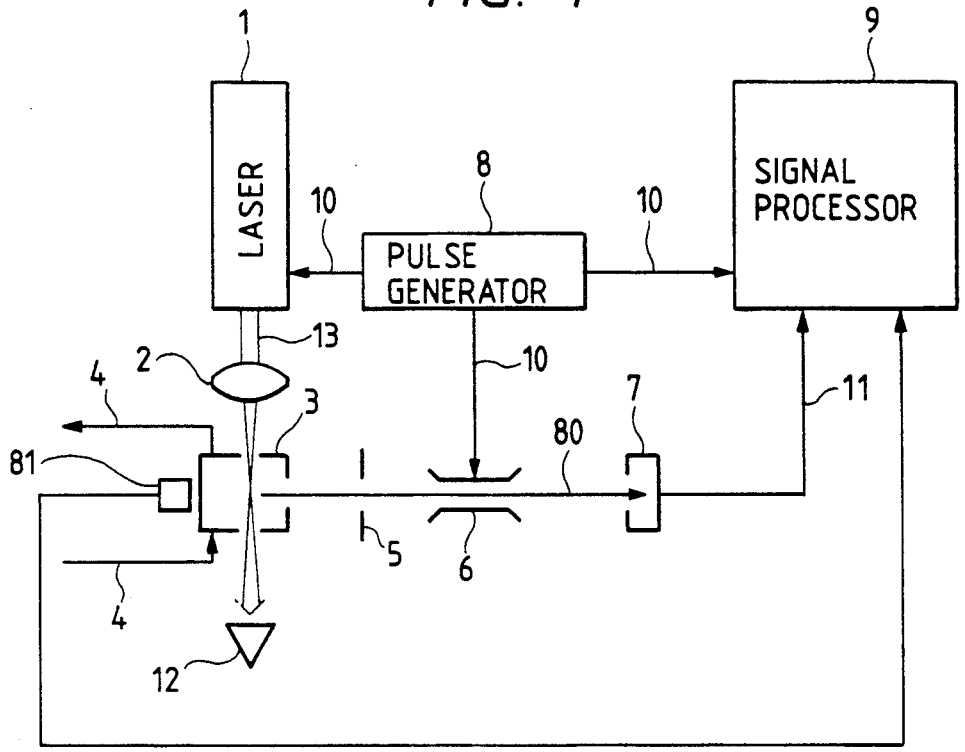
FIGS. 1 and 2 are views of first and second embodiments of the invention, respectively.

In FIG. 1, the fundamental structure of the present invention is shown. A laser 1 emits a laser beam 13 having a wavelength of 1064 nm, a pulse width of 10 ns and an output of 100 mJ. Preferably, the laser is a pulsed YAg laser (Yttrium-Aluminum-garnet laser). The laser beam 13 is condensed by a condenser lens 2 and enters a gas breakdown chamber 3. The laser beam 13 focuses within the breakdown chamber 3 and induces the laser breakdown of the gas in the vicinity of the focal point of the beam. The laser beam 13 passes through the breakdown chamber 3 and is absorbed by a beam stopper 12.

The gaseous sample to be ionized by the laser beam is introduced to the breakdown chamber 3 through a sample passage 4 and discharged. The constituent atoms of the gaseous sample that are converted into a plasma by the laser breakdown and ionized in the breakdown chamber 3 are accelerated by an accelerating electrode 5 through a slit in the breakdown chamber. The ions pass through slit 5 and are introduced to an ion deflector 6 of a time-of-flight mass spectrometer (hereinafter referred to as "TOF"). The ion detector 6 is actuated synchronously with the laser 1 and introduces the ions 80 generated by the laser breakdown to an ion collector 7. An ion current 11 from the ion collector 7 is processed to obtain the time-of-flight mass spectrum (hereinafter referred to as "TOF spectrum") on the basis of the time at which the ion deflector 6 has been actuated. A pulse generator 8 generates a control signal 10 for actuating laser 1, the ion deflector 6 and the signal processor 9 synchronously with each other.

Figure 2:
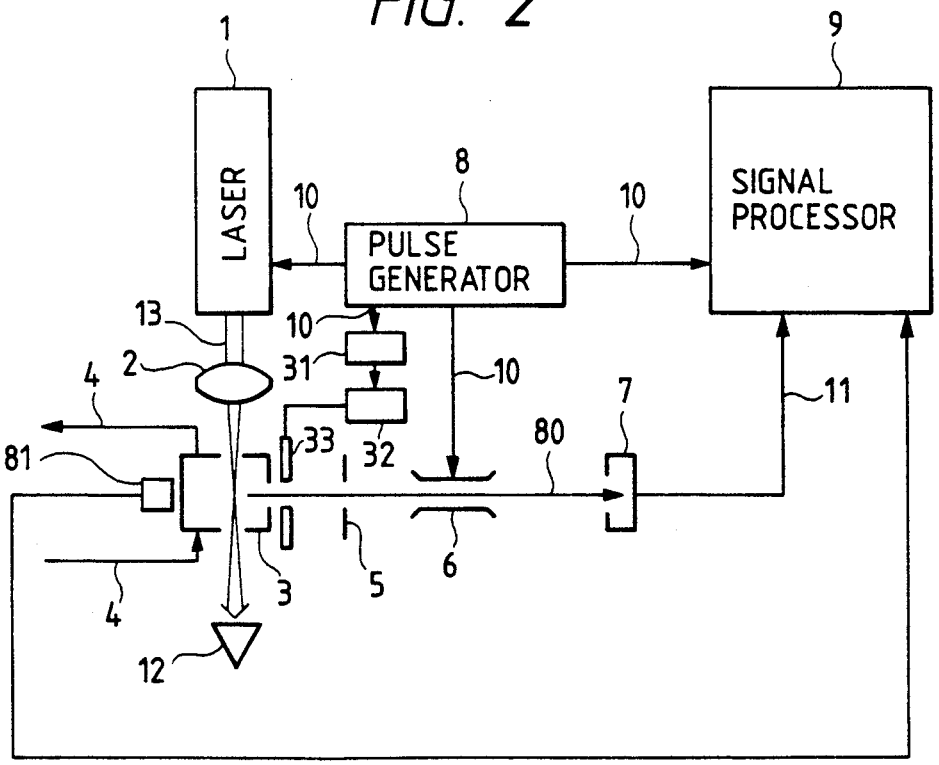

In FIG. 2, another embodiment of the present invention is shown. This second embodiment of the invention differs from the first in that a signal delay controller 31, a voltage applier 32 and an ion take-out electrode 33 are provided. The signal delay controller 31 actuates the voltage applier 32 at a preset time after the time at which a pulse signal is generated so as to apply a voltage to the ion take-out electrode 33. Then, it is accelerated by the accelerating electrode 5 and introduced to the ion deflector 6 of the TOF.

Accordingly, it is possible to spectrometrically analyze the mass of the sample by taking out the ions in the plasma at a preset time after the sample is broken down into the form of a plasma. Preferably, the plasma emission is spectrometrically measured by a device 81. The output of the measurement device 81 is input to the signal processor 9, and it is determined whether or not the intensity of the atom emission lines or the monovalent ion emission lines exceed a preset value. When the preset value is exceeded, then the low valent ions including the monovalent ions are extracted for spectrometric analysis.

Figure 3:
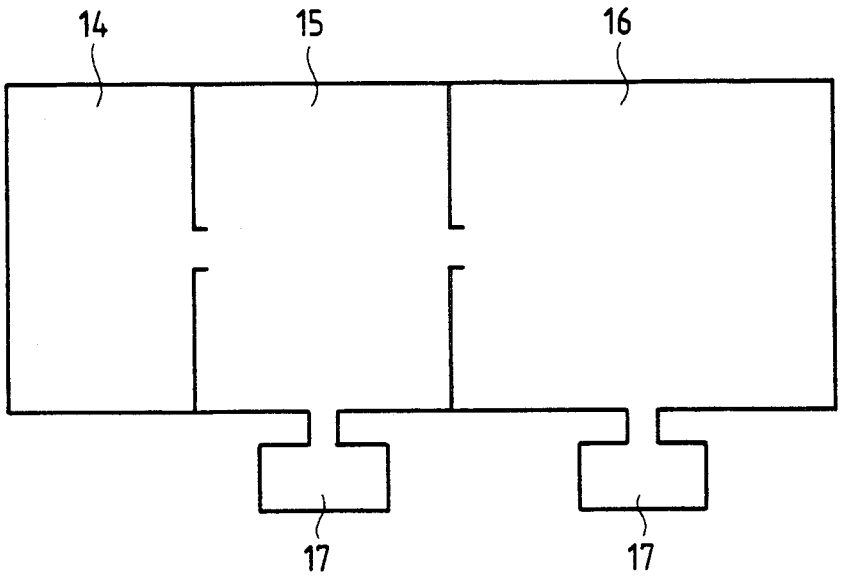
FIG. 3 is a view of the sample container and vacuum chamber system for the apparatus of the invention shown in FIGS. 1 and 2.

FIG. 3 shows a preferred chamber system for containing the plasma and taking out the ions. The sample is contained in ionizing portion 14, which is a breakdown chamber maintained at atmospheric pressure. A differential evacuating portion 15 houses the accelerating electrode 5, for example, and is evacuated to a pressure of $10^{-1}$ Pa by a turbo molecular pump 17. A further chamber 16 houses the mass spectrometer, for example, and is evacuated to $10^{-3}$ Pa by another turbo molecular pump 17. Therefore, with this preferred arrangement, the ions generated under atmospheric pressure are introduced into the high vacuum chambers.

Figure 4:
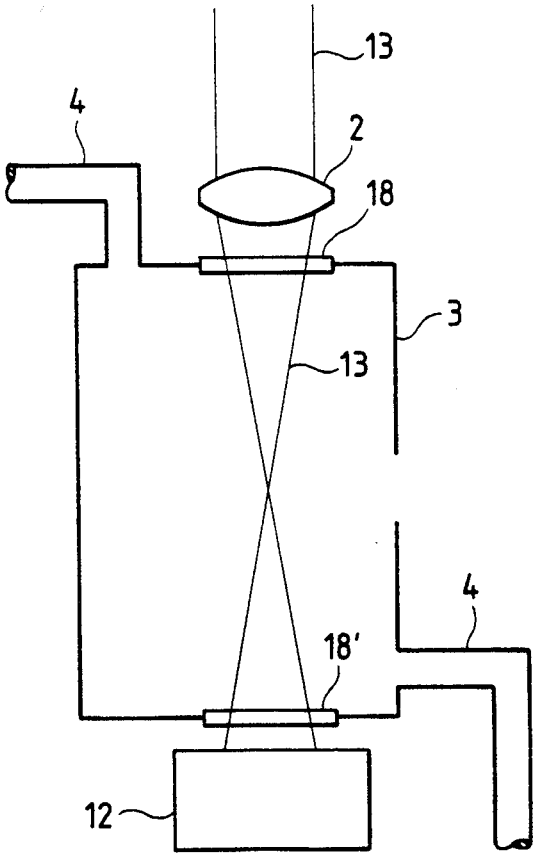
FIG. 4 is a view of a breakdown chamber constructed according to the present invention for a gaseous sample.

The breakdown chamber 3, shown in the embodiments of the invention in FIGS. 1 and 2, is able to contain gaseous, liquid and solid samples. Breakdown chamber 3 is shown in greater detail in FIG. 4. A gaseous sample is introduced into the breakdown chamber 3 through the sample passage 4. The laser beam 13 is condensed by a condenser lens 2, radiated into the breakdown chamber through an aperture 18 disposed at the top of the chamber, and is absorbed by a beam stopper 12 disposed outside of the chamber after passing through an aperture 18'. The power density of the laser beam is adjusted to exceed the breakdown threshold value of the sample in the vicinity of the focal point, and therefore the gaseous sample is ionized by the laser breakdown. When the sample is a particulate substance suspended in a gas, only the particulate substance is broken down and the gas medium is not ionized. For example, if the power density of the laser beam is set at a value of not less than $10^{12}$ W/cm$^2$, the gaseous sample is broken down and ionized. If the power beam density is set at a value of $10^{10}$ to $10^{11}$ W/cm$^2$, only the particulate substance in the gas is broken down. On the other hand, if the power density of the laser beam is set at a value of $10^{11}$ to $10^{12}$ W/cm$^2$, only the particulate or liquid substance suspended in the gas is broken down, thereby enabling the analysis of a substance in the form of a droplet.

Figure 5:
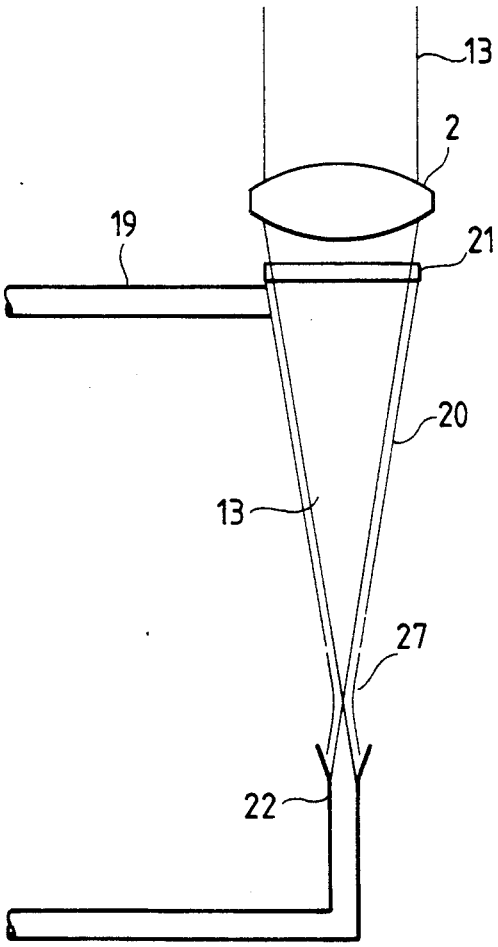
FIG. 5 is a view of a breakdown chamber constructed according to the present invention for a liquid sample.

When a liquid sample is to be analyzed, preferably a breakdown chamber 20, as shown in FIG. 5, is used. The breakdown chamber 20 is of a conical shape, and the liquid is introduced into the chamber through a sample pipe 19. The top surface of the conical breakdown chamber 20 has an aperture 21, and the lower portion of the breakdown chamber 20 is narrowed to form a narrow hole 27. The liquid sample is discharged from a sample discharge pipe 22 in the form of a very fine stream through the narrow hole. The laser beam 13 is condensed by the condenser lens 2 and is introduced to the breakdown chamber 20 through aperture 21. The laser beam is condensed along the inner wall surface of the conical breakdown chamber 20 and focuses at the point at which the laser beam passes through the narrow hole to outside of the breakdown chamber 20. Therefore, the laser beam focuses midway of the narrow stream just inside the narrow hole 27 at the lower portion of the chamber, thereby inducing a breakdown of the sample. In this way, the liquid sample is ionized in air by laser breakdown. In operation, if the power density of the laser beam at the focal point is set at a value of not less than $10^{11}$ W/cm$^2$, the liquid sample can be broken down and ionized, thereby enabling the analysis of the liquid for elemental constituents. If the power density of the laser beam at the focal point is set at $10^{10}$ W/cm$^2$, only the particulate substance in the liquid will be broken down and ionized, thereby enabling an analysis of a particulate substance suspended in the liquid.

In FIG. 5, the laser beam is focused on a portion of a narrow stream of the liquid that has emerged from narrow hole 27 at the lower portion of the breakdown chamber 20. Alternatively, the liquid sample may be broken down by focusing the laser beam on a droplet of the liquid sample that has emerged from the narrow hole 27 at the lower portion of the chamber. It is also possible to break down the liquid by radiating the laser beam in the horizontal direction such that it focuses on the narrow stream or on a droplet of the liquid sample at a predetermined location within the chamber.

Figure 6:
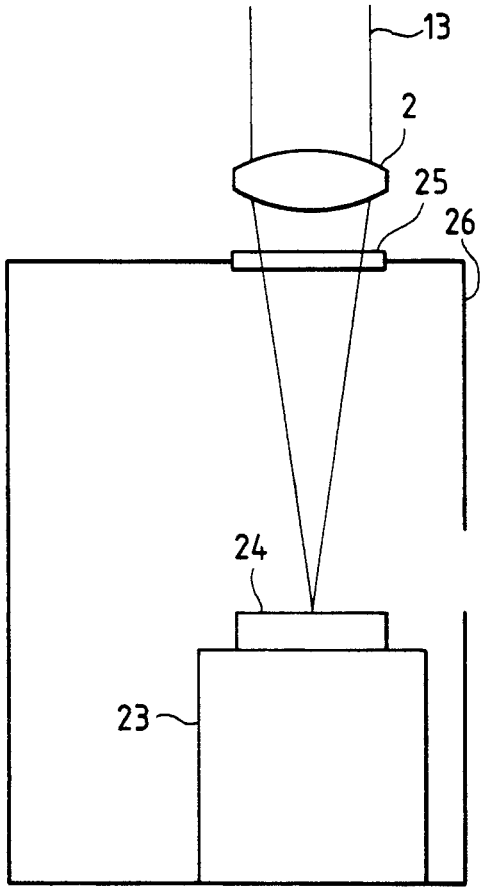
FIGS. 6 to 9 are views of a breakdown chamber constructed according to the present invention for a solid sample.

In the case of analyzing a solid sample, a breakdown chamber 26 is preferably used, as shown in FIG. 6. The laser beam 13 is condensed by the condenser lens 2 and a focal lens 25 is provided in an upper portion of the breakdown chamber 26. The solid sample 24 is fixed on a sample table 23 disposed in a lower portion of the breakdown chamber 26. The power density of the laser beam is adjusted to be $10^9$ to $10^{11}$ W/cm$^2$, and a plasma is formed.

Figure 7:
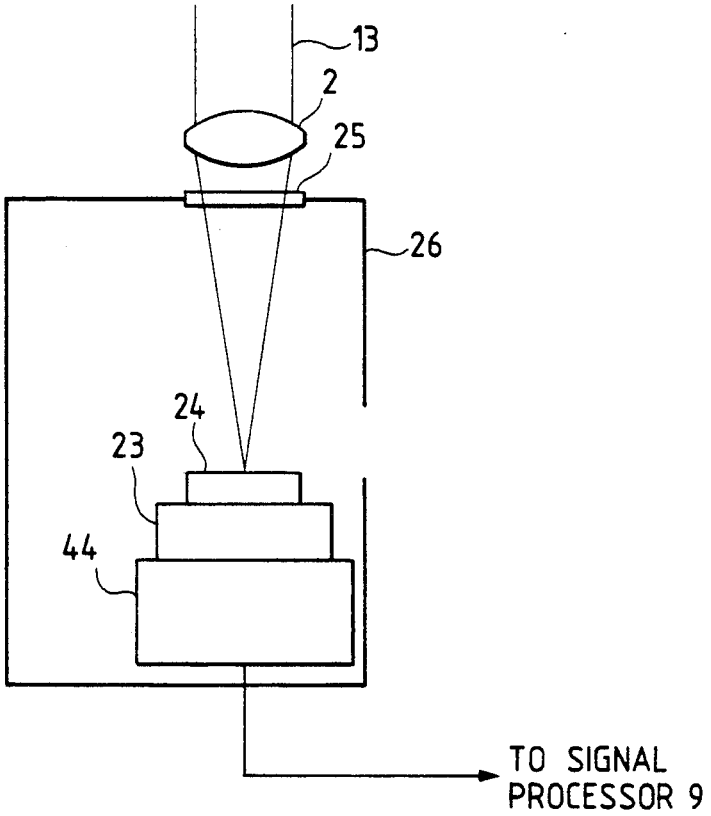

Another embodiment of a breakdown chamber for a solid sample is shown in FIG. 7. In this embodiment, a sample table driving and controlling device 44 is provided to enable the laser beam to be irradiated onto a given portion of a sample 24 by moving the sample table 23.

Figure 8:
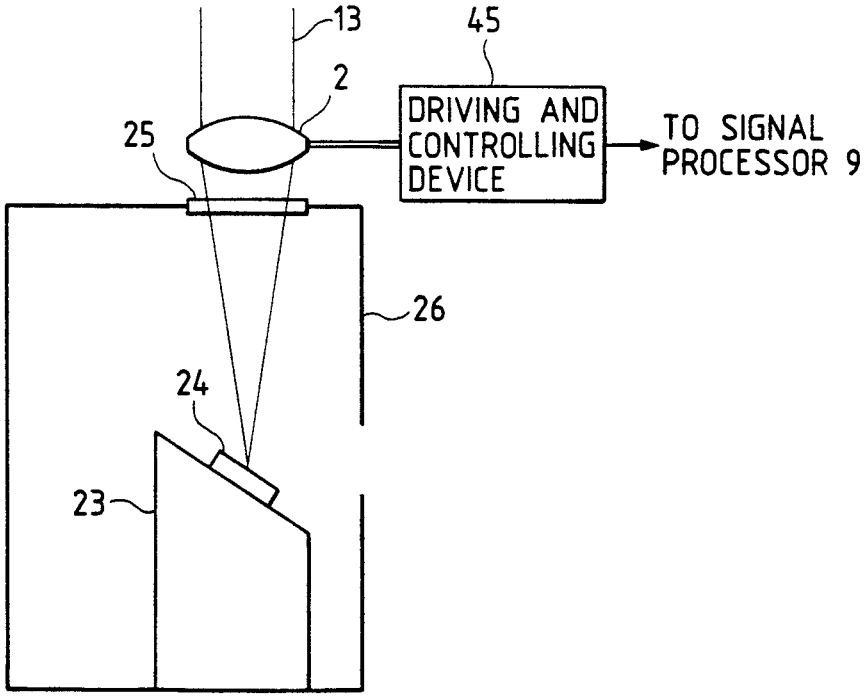

In FIG. 8, a driving and controlling device 44 is shown for moving the condenser lens 2 to thereby control the position and the direction of the laser beam. In this way, scanning of the sample with the laser beam in the breakdown chamber can be performed.

Figure 9:
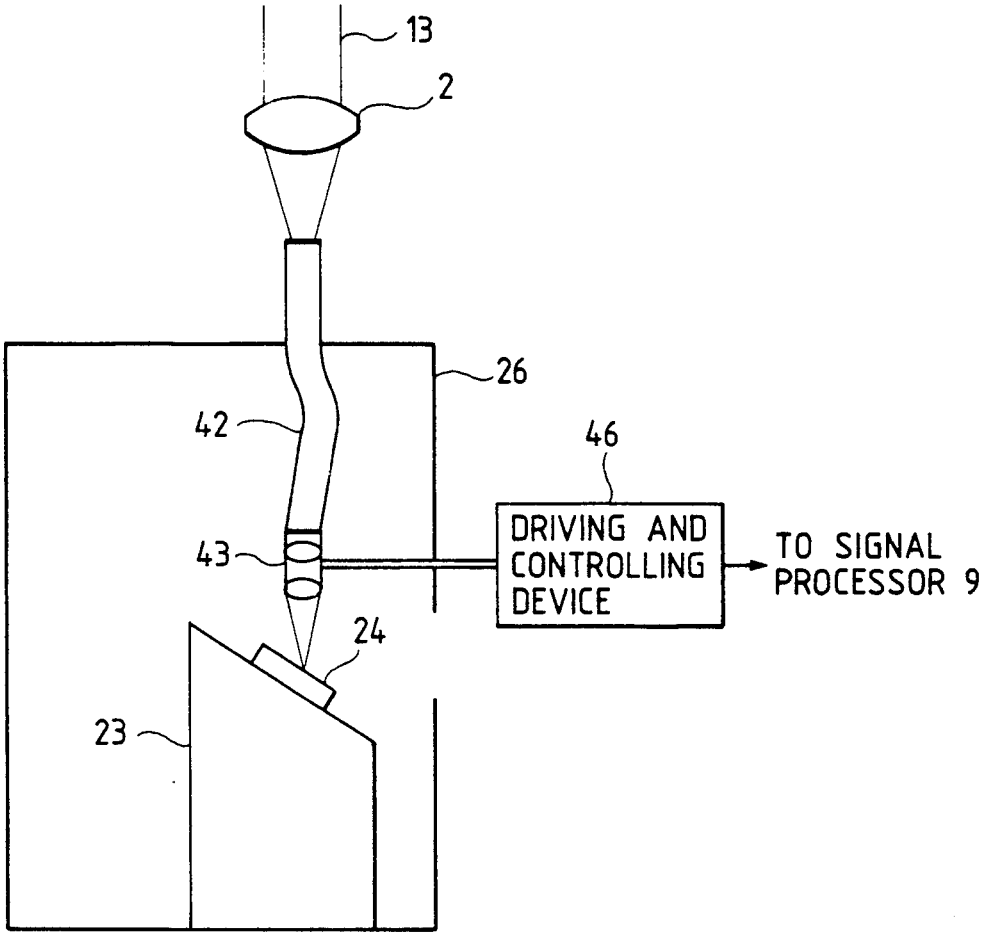

In FIG. 9, another embodiment of the present invention is shown that includes a driving and controlling device 46 for moving a condenser lens system 43 to enable positioning of the laser beam and to enable scanning irradiation of the object being analyzed.

In FIGS. 7 to 9, a signal relating to the position of the sample table and an output from the respectively disclosed driving and controlling device are supplied to signal processor 9, shown in FIGS. 1 and 2. The signal processor 9 calculates and stores the position of the laser beam on the sample surface, according to movement of the sample table 23 by driving and controlling device 44; the condenser lens 22 by driving and controlling device 45; and the condenser lens system 43 by driving and controlling device 46, respectively.

Figure 10:
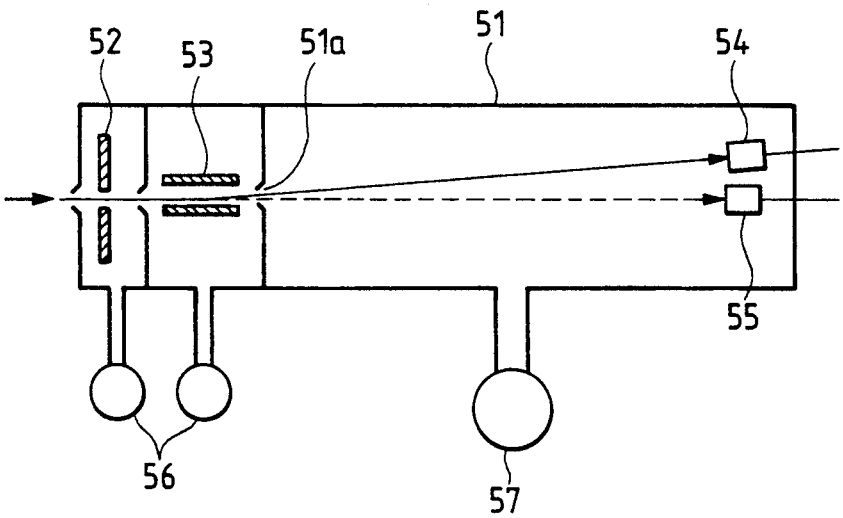
FIGS. 10 and 11 are views of a time-of-flight mass spectrometer used in the present invention.

FIG. 10 shows an example of a time-of-flight mass spectrometer. The ions generated by the breakdown are taken out by an ion take-out electrode 52 disposed in an ion flight tube 51. The ions enter the ion flight tube 51 through the entrance 51*a* provided at one end of the tube 51. The direction of progress of the ions is deviated by a minute angle influenced by an ion deflector 53 so that the path of flight of the ions is separated from the path of flight of the neutral atoms. Then, the number of ions are measured by an ion detector 54. The time required for the ions to reach the ion detector 54 after passing the ion take-out electrode 52 differs in proportion to the mass of the ions. It is therefore possible to determine the mass of the ions from the time difference of the detection signal of the ion detector 54 and to obtain the number of ions from the intensity of the detecting signal. A neutral atom is not influenced by the ion deflector 53 and enters an atom detector 55. The total number of atoms is obtained from the detection signal of the atom detector 55. Preferably, the ion flight tube is evacuated to a low pressure by molecular turbo pumps 56 and 57.

Figure 11:
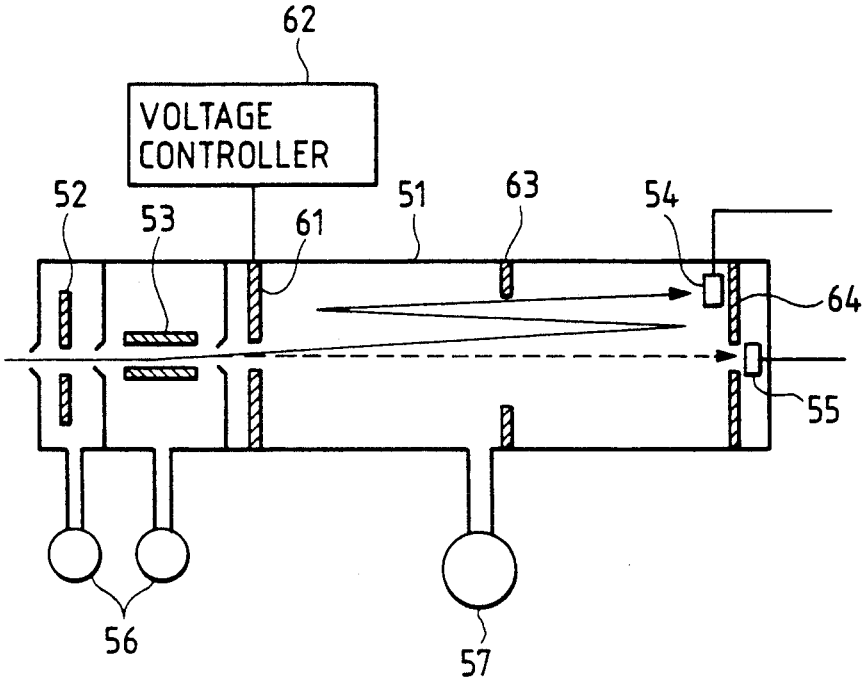

FIG. 11 shows another example of a time-of-flight mass spectrometer, wherein the ion flight tube 51 is further provided with the electrodes 61, 63 and 64, as well as electrodes 52 and 53. A voltage controller 62 is provided for the electrode 61. The ions taken out of the breakdown chamber pass through electrode 52 and are deflected by an ion deflector 53, as in the TOF shown in FIG. 10. The ions pass through the midportion of the tube 51 and are influenced by an electrode 63. Then, the ions are repelled by electrode 64 and are reversed in direction. Traveling in the reversed direction through the midportion of the tube, the ions are again deflected by electrode 63. Then, voltage controller 62 changes the potential of the electrode 61 whereupon the ions reverse direction again. The ions, having been twice reversed in direction, now proceed to the ion detector 54, which measures the ion current so as to obtain the number of ions. This system is advantageous in that the distance of flight of the ions is lengthened, and the time difference in flight between the different ions increases so that resolution of the mass is enhanced, and it is possible to make the ion flight tube smaller in length.

Figure 12:
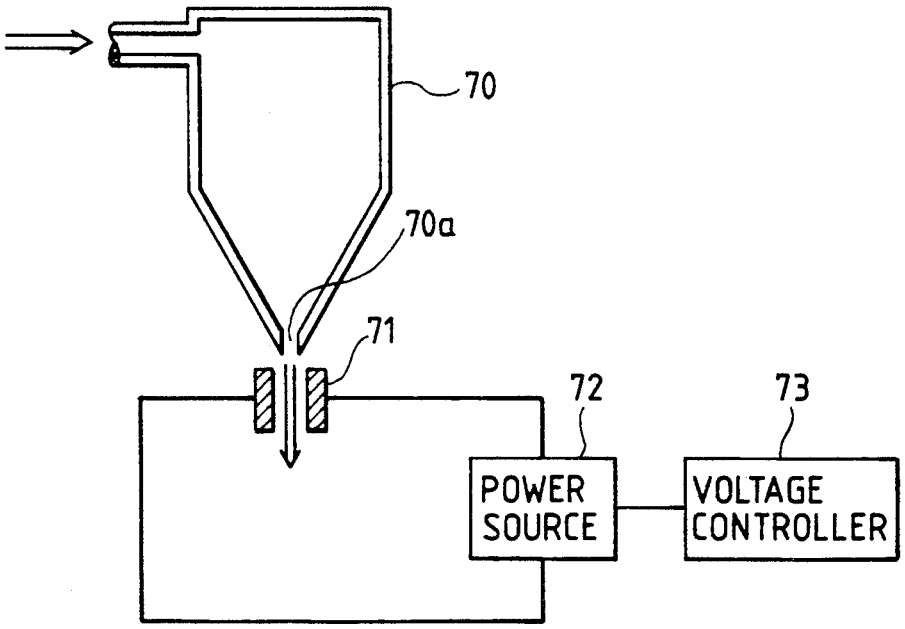
FIG. 12 is a view of a breakdown chamber for a liquid sample constructed according to another embodiment of the invention.
Figure 13:
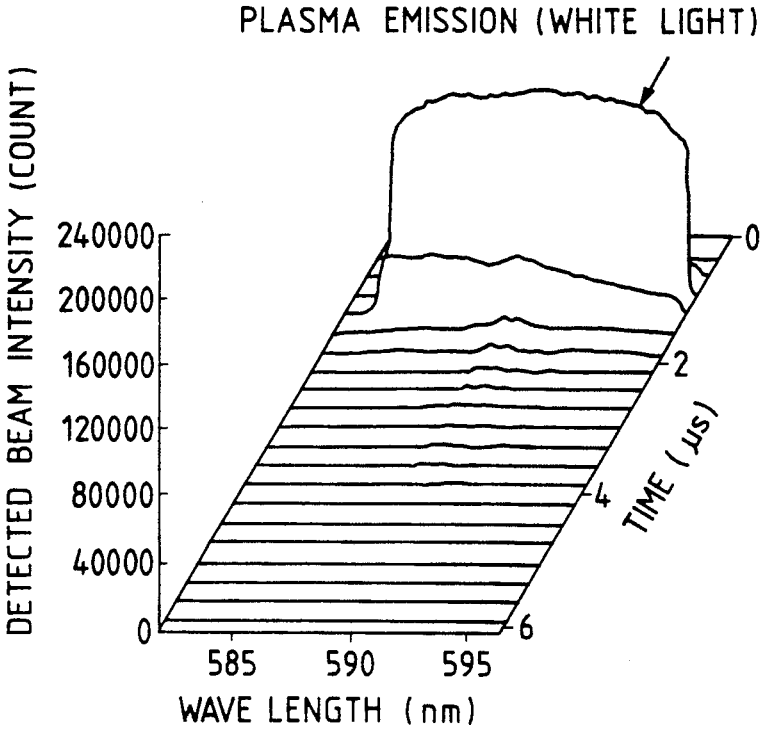
FIGS. 13(*a*) and 13(*b*) are diagrams of a breakdown plasma emission spectrum of a Na solution sample.
Figure 13:
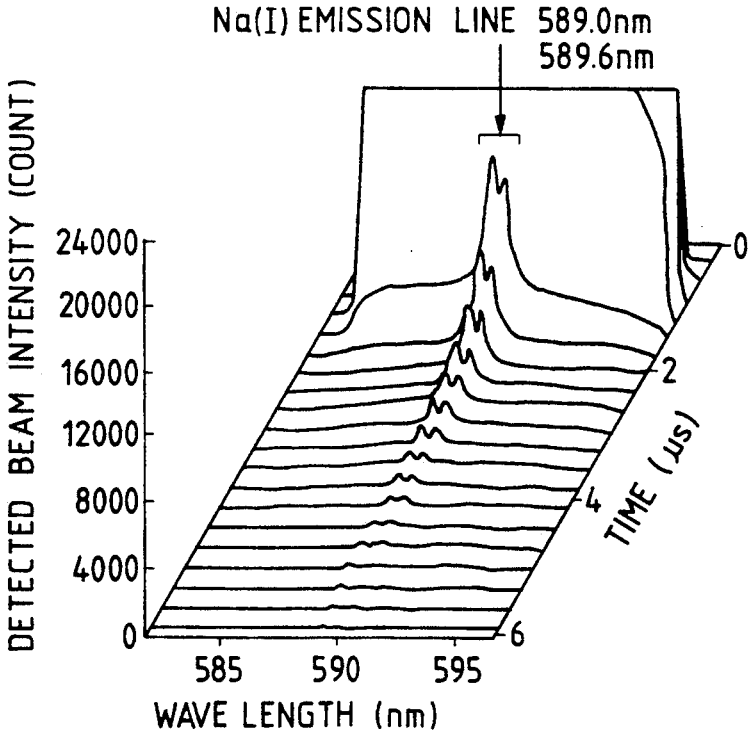

FIG. 12 shows another embodiment of a breakdown chamber and method of breaking down and ionizing a liquid. A liquid sample is contained in a liquid container 70 that is funnel-shaped and provided with a small hole 70*a* formed at the tip of the funnel. The liquid sample emerges from liquid container 70 through the small hole 70*a* at the lower portion of the container in the form of a fine line or a droplet. The fine line or droplet passes through a gap provided between a pair of opposing electrodes 71. A power source 72 is actuated in accordance with a control signal derived from a voltage application controller 73 that applies a high voltage to the electrodes 71 in a pulse-like manner. The voltage applied to the electrodes 21 is set at a value above the dielectric breakdown threshold voltage (about $10^6$ V/cm).

Figure 14:
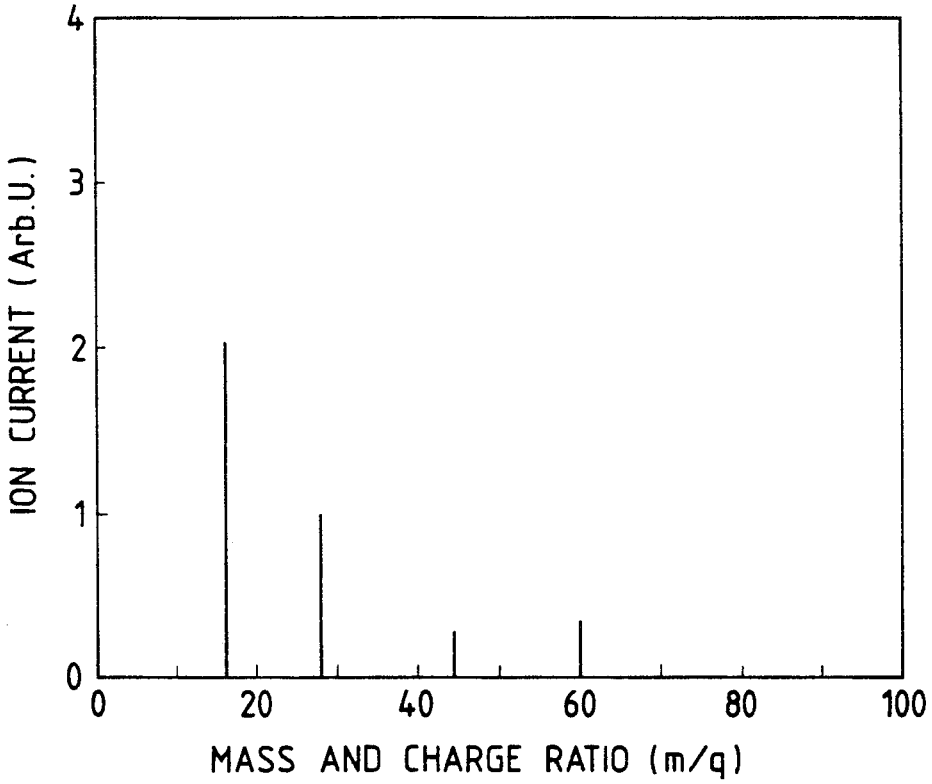
FIG. 14 is a diagram showing the mass spectrum of a particulate substance in air.

FIG. 14 shows a TOF spectrum of a particulate substance in a gas measured in accordance with an embodiment of the present invention wherein the particulate substance was ionized by a laser beam. In the TOF spectrum, the peaks of Si having a mass of 28, and 0 having a mass of 16 are mainly detected and it is observed that the main constituent of the particulate substance is $SiO_x$. The peak having a mass of 44 is identified to be the peak of $SiO^-$ and the peak having a mass of 60 is identified to be the peak of $SiO_2^-$.

In accordance with the present invention, it is possible to ionize and analyze a sample in any form or state, such as a gaseous state, liquid state or solid state. Further, it is possible to selectively ionize and analyze a particulate substance suspended in a gas or a liquid. The sample can be of various types, such as an insulator, semiconductor or conductor, as well as a metal or an oxide. Even a substance having a high ionization potential is able to be broken down by the apparatus of the invention for analysis.

In particular, the apparatus of the invention generates monovalent or low valent ions with efficiency by breakdown, thereby enabling analysis of the substance with high sensitivity. Therefore, even trace element constituents of a substance suspended in a gas or liquid can be analyzed.

According to the present invention, it is possible to analyze a substance for elements or molecules by varying the power density of the laser beam used in irradiating the sample. Furthermore, the element constituent analysis is enabled with high sensitivity by an efficiently sized apparatus that combines laser breakdown of the sample with time-of-flight mass spectrometry.

While a preferred embodiment of the invention has been described with variations, further embodiments, variations and modifications are contemplated within the spirit and scope of the follow claims.

We claim:

1. A method for the mass spectrometric analysis of a sample, comprising the steps of:

irradiating the sample with a laser beam having a power density that is higher than a threshold value for laser breakdown of the sample and that is also near the threshold value to thereby achieve laser breakdown of the sample so that ions generated by said irradiating are mainly low valent ions, said irradiating including adjusting said power density of the laser beam to form a plasma from the sample;

extracting said low valent ions from the plasma when at least one of an atom emission line and a low-charged ion emission line is observed; and analyzing spectrometrically the mass of said extracted low valent ions.

2. A method for the mass spectrometric analysis according to claim 1, wherein said extracting includes extracting said low valent ions from the plasma when an intensity of one of said emission lines exceeds a preset value.

3. A method for the mass spectrometric analysis of a sample according to claim 1, wherein said analyzing includes analyzing spectrometrically the ions by using a time-of-flight mass spectrometer.

4. A method for the mass spectrometric analysis of a sample according to claim 1, wherein said irradiating includes adjusting the power density of the laser beam so that the ions generated by said irradiating are mainly monovalent and divalent ions.

5. A method for the mass spectrometric analysis of a sample according to claim 1, wherein:

said irradiating includes adjusting said power density of the laser beam so that a plasma is formed from the sample and so that mainly said low valent ions are formed in the plasma; and said extracting includes extracting said low valent ions form the plasma after a preset time has elapsed since a time when the plasma is formed.

6. A method for the mass spectrometric analysis of a sample according to claim 5, wherein said extracting includes extracting said low valent ions from the plasma after the preset time has elapsed and before said low valent ions have recombined with free electrons present in the plasma to form neutral atoms.

7. A method for the mass spectrometric analysis of a sample according to claim 1, wherein said irradiating includes irradiating a solid sample as the sample, including selectively adjusting the laser beam so that the power density of the laser beam is at least $10^{10}$ to less than $10^{11}$ W/cm$^2$.

8. A method for the mass spectrometric analysis of a sample according to claim 1, wherein said irradiating includes irradiating a liquid sample as the sample, including selectively adjusting the power density of the laser beam to be within $10^{11}$ to less than $10^{12}$ W/cm$^2$.

9. A method for the mass spectrometric analysis of a sample according to claim 1, wherein said irradiating includes irradiating a gaseous sample as the sample, including selectively adjusting the power density of the laser beam to be at least $10^{12}$ to less than $10^{13}$ W/cm$^2$.

10. A method for the mass spectrometric analysis of a sample according to claim 1, wherein said irradiating includes irradiating particulate substance contained in a fluid as the sample, including selectively adjusting the power density of the laser beam to be high enough to achieve laser breakdown of the particular substance, but no so high so as to achieve laser breakdown of the fluid.

11. A method for the mass spectrometric analysis of a sample according to claim 1, wherein said irradiating includes irradiating a substance in the form of a droplet in a gas as the sample, including selectively adjusting the power density of the laser beam to achieve laser breakdown of the substance in the form of a droplet without achieving laser breakdown of the gas.

12. A method for the mass spectrometric analysis of a sample, comprising the steps of:

irradiating the sample with a laser beam having a power density that is higher than a threshold value for laser breakdown of the sample and that is also near the threshold value to thereby achieve laser breakdown of the sample so that ions generated by said irradiating are mainly low valent ions;

extracting said low valent ions from the plasma when at least one of an atom emission line and a low-charged ion emission line is observed; and analyzing spectrometrically the mass of said extracted low valent ions;

wherein said irradiating includes adjusting said power density of the laser beam so that a plasma is formed from the sample and so that mainly said low valent ions are formed in the plasma; and said extracting includes extracting said low valent ions from the plasma after a preset time has elapsed since a time when the plasma is formed.

13. A method for the mass spectrometric analysis of a sample according to claim 12, wherein said extracting includes extracting said low valent ions from the plasma after the preset time has elapsed and before said low valent ions have recombined with free electrons present in the plasma to form neutral atoms.

14. A method for the mass spectrometric analysis of a sample according to claim 12, wherein said irradiating includes irradiating a solid sample as the sample, including selectively adjusting the laser beam so that the power density of the laser beam is at least $10^{10}$ to less than $10^{11}$ W/cm$^2$.

15. A method for the mass spectrometric analysis of a sample according to claim 12, wherein said irradiating includes irradiating a liquid sample as the sample, including selectively adjusting the power density of the laser beam to be within $10^{11}$ to less than $10^{12}$ W/cm$^2$.

16. A method for the mass spectrometric analysis of a sample according to claim 12, wherein said irradiating includes irradiating a gaseous sample as the sample, including selectively adjusting the power density of the laser beam to be within $10^{12}$ to less than $10^{13}$ W/cm$^2$.

17. A method for the mass spectrometric analysis of a sample according to claim 12, wherein said irradiating includes irradiating particulate substance contained in a fluid as the sample, including selectively adjusting the power density of the laser beam to be high enough to achieve laser breakdown of the particular substance, but no so high so as to achieve laser breakdown of the fluid.

18. A method for the mass spectrometric analysis of a sample according to claim 12, wherein said irradiating includes irradiating a substance in the form of a droplet in a gas as the sample, including selectively adjusting the power density of the laser beam to achieve laser breakdown of the substance in the form of a droplet without achieving laser breakdown of the gas.

19. A method for the mass spectrometric analysis of a sample according to claim 12, wherein said analyzing includes analyzing spectrometrically the ions by using a time-of-flight mass spectrometer.

20. An apparatus for mass spectrometric analysis of a sample, comprising:

a laser for ionizing a sample by irradiating the sample with a laser beam, means for adjusting a power density of the laser beam to be higher than a threshold value for laser breakdown of the sample and to form a plasma from the sample;

means for measuring at least one of an atom emission line and a low-charged ion emission line of the plasma;

means for extracting ions from the plasma when one of the atom emission line and the low-charged ion emission line is observed; and means for analyzing spectrometrically the mass of said ions that are extracted.

21. An apparatus for mass spectrometric analysis of a sample, comprising:

a container for accommodating the sample which is to be analyzed;

a laser beam irradiator for irradiating the sample with a laser beam to achieve laser breakdown of the sample so as to form a plasma;

means, including an ion take-out electrode, for taking out ions from said plasma from the time in which said ions in said plasma become monovalent ions up until the time in which the ions in said plasma recombine with free electrons in the plasma to form neutral atoms;

a device for spectroscopic measurement of plasma emission; p1 means for applying a voltage to said ion take-out electrode when at least one of an atom emission line and a low-charged ion emission line is observed through said spectroscopic measurement device; and means for spectrometrically analyzing the mass of the ions taken out.

22. An apparatus for mass spectrometric analysis according to claim 21, wherein said means for applying voltage to said ion take-out electrode applies voltage when the intensity of said at least one of an atom emission line and a low-charged ion emission line exceeds a preset value.

23. An apparatus for mass spectrometric analysis according to claim 22, wherein said container for accommodating a sample includes means for narrowly confining a fluid sample, and wherein said laser irradiates a portion of said sample accommodating device at a position where said fluid sample is narrowly confined with a power density for achieving laser breakdown of said fluid sample.

24. An apparatus for mass spectrometric analysis according to claim 21, wherein said container for accommodating a sample includes means for narrowly confining a fluid sample, and wherein said laser irradiates a portion of said sample accommodating device at a position where said fluid sample is narrowly confined with a power density for achieving laser breakdown of said fluid sample.

25. An apparatus for mass spectrometric analysis according to claim 21, wherein said means for spectrometrically analyzing a mass is a time-of-flight mass spectrometer.

26. An apparatus for mass spectrometric analysis according to claim 21, wherein said laser beam irradiator is a pulsed laser having a pulsed laser beam for breaking down the sample in to the plasma form.

27. An apparatus for mass spectrometric analysis according to claim 26, further comprising:

said means for taking out ions including an ion take-out electrode; and means for applying a voltage to said ion take-out electrode after a preset time has elapsed since the sample is irradiated by a laser beam pulse.

* * * * *